United States Patent [19]

Casey

[11] 4,018,956

[45] Apr. 19, 1977

[54] METHOD OF MAKING A DIFFERENTIALLY SHRUNK FLOCKED FABRIC, AND FLOCKED FABRIC PRODUCT

[75] Inventor: James P. Casey, Seekonk, Mass.

[73] Assignee: Microfibres, Inc., Pawtucket, R.I.

[22] Filed: Oct. 3, 1975

[21] Appl. No.: 619,212

[52] U.S. Cl. ..... 428/86; 427/197; 427/200; 427/202; 427/206; 428/88; 428/89; 428/90; 428/95; 428/96; 428/201

[51] Int. Cl.[2] ..... D03D 27/00; D04H 11/00

[58] Field of Search ..... 428/86, 88, 89, 90, 428/95, 196, 201; 427/197, 200, 206, 202

[56] References Cited

UNITED STATES PATENTS

| | | | |
|---|---|---|---|
| 3,262,128 | 7/1966 | Morgan | 427/206 |
| 3,336,149 | 8/1967 | Fox | 428/88 |
| 3,518,154 | 6/1970 | Broadhurst | 428/89 |
| 3,540,974 | 11/1970 | Broadhurst | 428/88 |

*Primary Examiner*—Marion E. McCamish
*Attorney, Agent, or Firm*—Miller and Prestia

[57] ABSTRACT

A pattern is printed with adhesive as a design on certain selected areas of a shrinkable substrate and the adhesive is dried. Flock is preferably applied to the selected design prior to drying. Supplemental adhesive is then applied to other areas ("background" areas) of the substrate, and is dried. Preferably such supplemental adhesive is applied over the surface of the entire substrate and over the adhering flock that has already been applied, and the entire substrate plus existing flock is covered with additional flock, followed by drying of the adhesive.

The entire substrate thus prepared is then subjected to shrinkage, causing differential shrinkage of the design areas and the background areas, and producing a fabric having a novel three-dimensional pattern or design.

The fabric product preferably has a plurality of upstanding flock fibres and the substrate is shrunken more tightly in some areas than in others.

29 Claims, 6 Drawing Figures

FIG. 1.
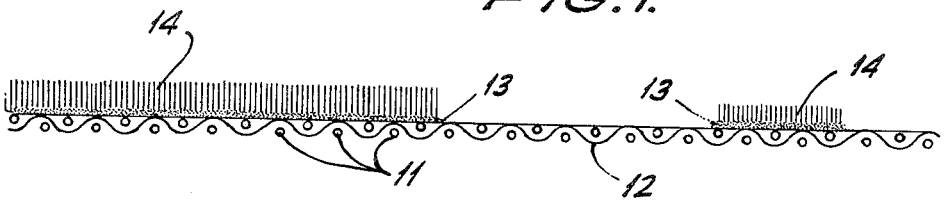
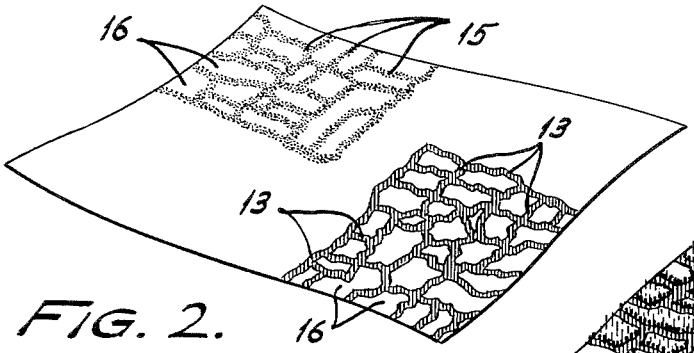
FIG. 2.
FIG. 3.
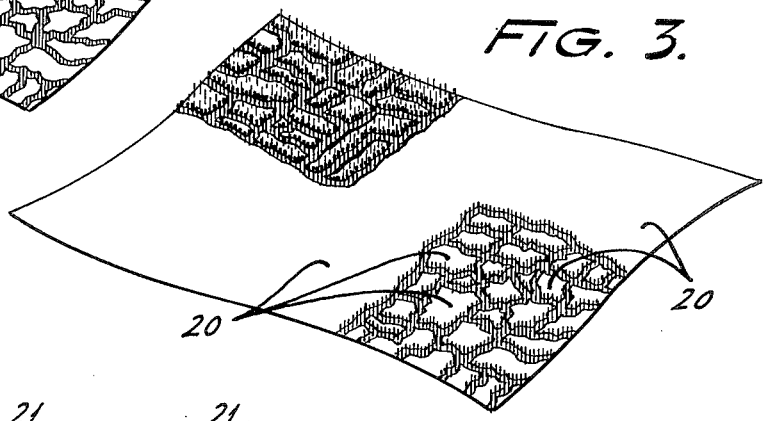
FIG. 4.
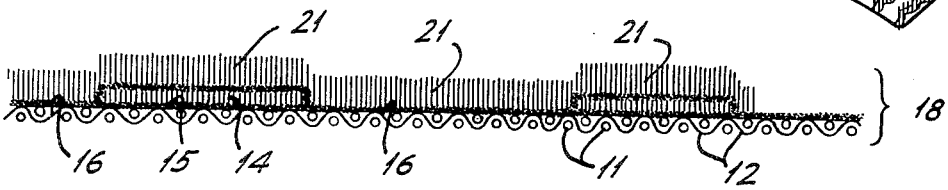
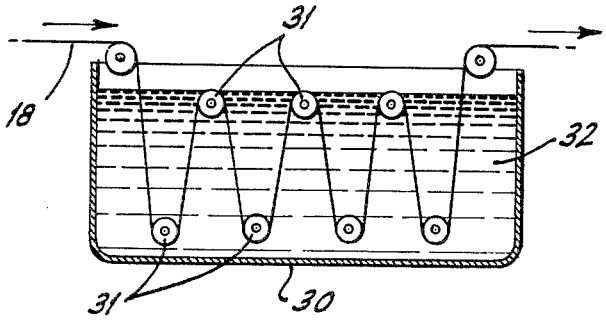
FIG. 5.
FIG. 6.
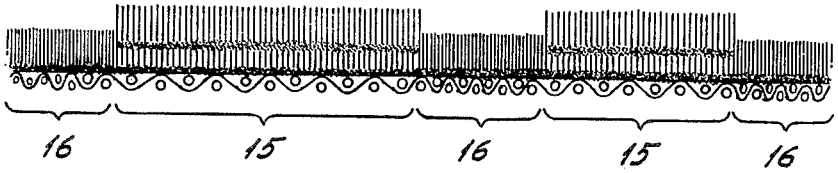

FIG. 7.
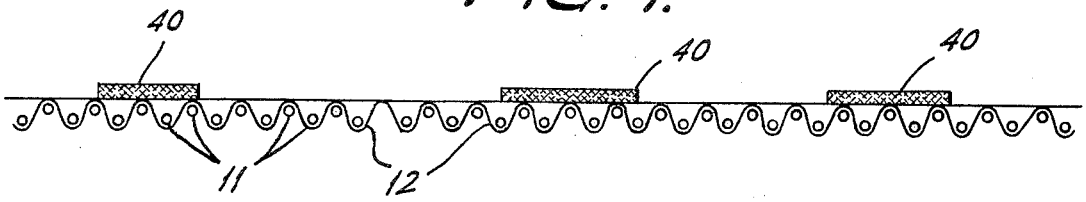
FIG. 8.
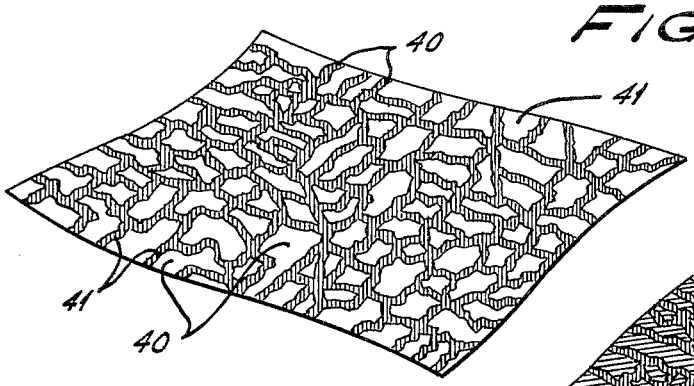
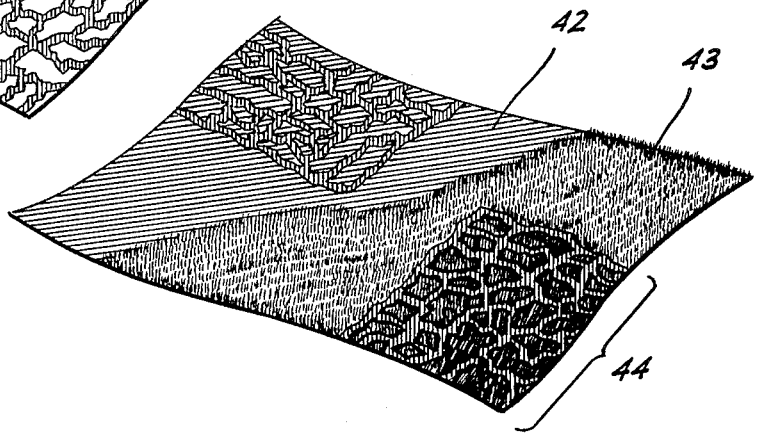
FIG. 9.
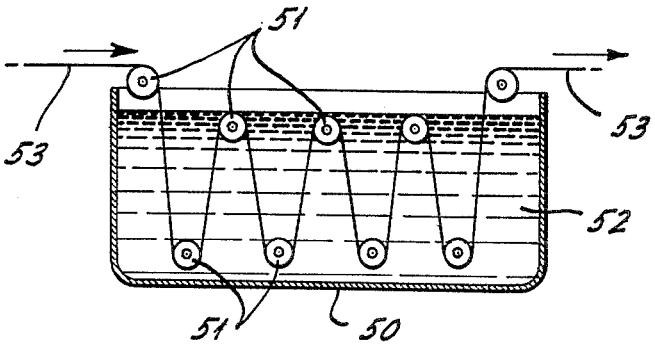
FIG. 10.
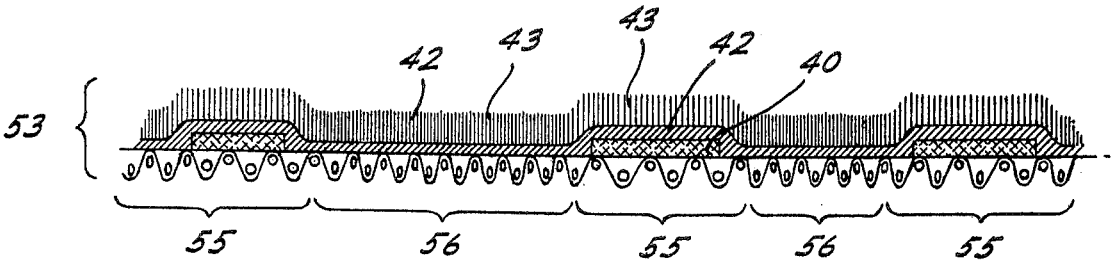
FIG. 11.

METHOD OF MAKING A DIFFERENTIALLY SHRUNK FLOCKED FABRIC, AND FLOCKED FABRIC PRODUCT

BRIEF DISCUSSION OF THE INVENTION

This invention relates to a method of making a novel fabric, preferably flocked, having a novel three-dimensional pattern, by differential shrinkage. It further relates to such a fabric, having a substrate certain portions of which are shrunken more tightly than others. The fabric is preferably flocked, and then overflocked, as will be described in detail hereinafter.

PRIOR ART

The reissue patent to Summers, U.S. Pat. Re. No. 23,741, discloses the idea of applying various kinds of flocks to different areas of a backing material. However, it does not disclose overflocking, nor does it disclose the stabilization of certain areas against shrinkage while permitting shrinkage in other areas, followed by wetting out in order to cause differential shrinkage.

The patent to Mumpower, U.S. Pat. No. 3,793,050 relates to the idea of performing successive flocking operations through successive stencils, in order to make a pattern containing flocks of different colors. There is no description of overflocking, or of differential shrinking of the substrate.

The patent to Saks, U.S. Pat. No. 2,527,501 discloses an adhesive layer from which flock extends on both opposite surfaces. Saks does not disclose the idea of selective overflocking, or of differential shrinkage.

The patent to Fountain, U.S. Pat. No. 2,368,706 discloses the idea of applying a predetermined printed pattern to a substrate, followed by flocking with two different types of flock, one of which is longer than the other. However, all of the flocks are adhered to the base substrate; there is no description of overflocking, nor is there any description of providing certain areas which are stabilized against shrinkage and other areas which are not stabilized against shrinkage.

The patent to Broadhurst, U.S. Pat. No. 3,518,154 discloses a two-stage flocking process, but does not begin with a continuous substrate such as a cotton fabric, for example. Broadhurst begins with a "release" type layer, which does not constitute a part of the final product, and deposits an adhesive grid on this "release" layer, then flocks upon the grid, then removes the resulting flocked grid to another substrate, and then flocks through the holes in the grid onto the other substrate. Here again, there is no concept of "overflocking", nor is there any disclosure of providing differential shrinkage in the substrate.

OBJECTS OF THE INVENTION

It is, accordingly, an object of this invention to provide a method of making a fabric, preferably flocked, which has a novel three-dimensional design of unusual texture and having a pleasing appearance. Other objects and advantages of this invention will appear in further detail hereinafter, and in the drawings, of which:

DRAWINGS

FIG. 1 is a sectional view of a substrate in accordance with one embodiment of this invention, certain portions of which have been flocked with a short flock, in one step of the method;

FIG. 2 is a perspective view of the surface of the substrate of FIG. 1, showing in its lower right hand corner a printed design, printed with an adhesive which serves as a stabilizer. At the upper right hand corner of FIG. 2 the same type of design is shown with short flock adhered to the adhesive;

FIG. 3 is a similar perspective view, schematically showing the lower right hand portion flocked with a short flock, and showing the upper left hand portion flocked with the same short flock but also overflocked with a somewhat longer flock;

FIG. 4 is a sectional view, showing the overflock of the upper left hand corner of FIG. 3 directly applied to the previously unflocked areas and overflocked on top of the short flocked design;

FIG. 5 is a sectional view of a water bath and shows schematically the step of wetting out the fabric of FIG. 4;

FIG. 6 is a view in cross-section of the product resulting from the step shown in FIG. 5, and shows the relatively unstabilized areas of the substrate in a highly shrunken condition while the relatively "stabilized" areas are less highly shrunken;

FIG. 7 is an enlarged sectional view of a fabric, illustrating the structure and arrangement of the fabric in an initial step of an alternative embodiment in accordance with this invention;

FIG. 8 illustrates in perspective a fabric corresponding to FIG. 7;

FIG. 9 illustrates in perspective the fabric of FIG. 8 which has been subjected to a still further step in accordance with the alternative procedure in accordance with this invention. At the upper left hand corner of FIG. 9 is shown the step of applying overall adhesive, over the "design" adhesive as applied in FIG. 8. The central and upper right hand portions of FIG. 9 illustrate the appearance of the fabric after having been subjected to an overall flocking step, and the lower right hand corner of FIG. 9 shows the appearance of the same fabric, which has been overflocked, and which has been subjected to a subsequent shrinkage;

FIG. 10 is a sectional view of a water bath and shows schematically the step of wetting out the fabric referred to above in connection with FIG. 9; and FIG. 11 is a sectional view, enlarged, showing in cross-section a product resulting from the steps of FIGS. 7 to 10.

DETAILED DESCRIPTION OF THE INVENTION

Although specific terms will be used hereinafter to describe with clarity the specific forms of the invention selected for illustration in the drawings, these are not intended to limit the scope of the invention, which is specifically defined in the claims.

Turning now to FIG. 1, a substrate 10 is shown, which is a shrinkable fabric. As shown, substrate 10 includes warp yarns 11 and filling yarns 12, but the substrate may be any type of shrinkable substrate, including woven, knitted or "non-woven" fabric, etc. However, it must possess the property of being shrinkable, either in hot or cold liquid, under the influence of wet or dry heat, or otherwise.

The number 13 designates a coating of adhesive, which has been applied only to certain areas of the substrate 10, in a manner to provide a desired design or pattern. The adhesive 13 is preferably applied by printing, although other methods such as spraying, silk screening, etc., may be used instead.

A multiplicity of flock fibres 14 are applied, preferably electrostatically, to the adhesive design areas (hereinafter referred to as "design" areas). The flock fibres 14 adhere substantially endwise and vertically to the adhesive 13, which is then dried or cured. Fibres 14 are preferably composed of short flock. In this form of the invention, the other areas, outside the "design" areas, are free of adhesive and are unflocked.

The partial or complete penetration of the adhesive 13 into the yarns 11, 12 of substrate 10, followed by drying or curing, tends to shrink the yarns 11, 12 only a minimal amount and no shrinkage is shown in the drawings. The "locking" action of the adhesive tends to limit the extent of further shrinkage of the design area in subsequent steps of the process.

FIG. 2 shows the surface appearance of a small piece of the fabric at this stage of its production. The printed design may, of course, be of any size, shape or type and the areas 15 have been subjected to adhesive and flock while the background areas 16 have not been covered with any adhesive, or as much adhesive, as the design areas. For convenience of reference hereinafter, and without any intention of limitation, the areas 15 will be referred to as "design" areas and the areas 16 as "background" areas. Either one may be larger, or of greater area, or of greater thickness or density than the other.

FIG. 3 shows schematically a further step of the method. Further adhesive 20 is applied, as indicated at the lower right hand portion of FIG. 3, preferably covering the entire surface of the fabric and covering both the (flocked) design areas 15 and the (unflocked) background areas 16. The entire surface is then flocked with flock 21, which applies flock 21 to the background areas 16 for the first time but which overflocks the flock 14 already present on the design areas 15. The upper left hand portion of FIG. 3 is intended to show the appearance of the product after the performance of this step of the method, while the lower right hand portion of FIG. 3 schematically illustrates the appearance of the fabric before overflocking.

In the performance of the foregoing step, the adhesive coating or layer 20 is dried or cured after the flocking (and overflocking) step. Such drying or curing tends to cause no shrinkage of the substrate, or only minimal shrinkage, and none is shown in the drawings.

The flock fibres 21 are applied to the background areas 16 (and are overflocked over the previously flocked design areas 15) are preferably, but not necessarily longer than the flock fibres 14, which preferably have a length of about 0.005 to 0.025 inch. Fibres 21 preferably have an average length of about 0.005 to 0.080 inch, and are preferably longer than fibres 14 by 50 to 200%.

FIG. 4 shows a typical structure of the fabric at this stage of the process. The (short) flock fibres 14 are secured to the substrate 10 in the design areas 15 while the longer fibres 21 are secured to the background areas 16 and are overflocked end-wise over the ends of the flock fibres in the design areas 15. The spacing between the warp yarns 11 remains uniform because substantially no shrinkage has taken place.

FIG. 5 shows the fabric 18 of FIG. 4 being subjected to a wetting-out process, which differentially shrinks the substrate at the areas 15, 16. An immersion tank 30 is shown, having guide rollers 31, for continuously passing the fabric through a bath 32, for example hot water at about 120° – 160° F. Heat processing, wet or dry, sometimes also suffices to cause shrinkage, and the shrinkage differs between areas 15 and 16 because of the different way in which they have previously been treated. The overflocked portions 15 tend to shrink less than the background portions 16 because the presence of multiple layers of adhesive and multiple layers of flock tends to stabilize the design portions 15 against shrinkage.

FIG. 6 shows the resulting fabric, after drying, with the portions 16 more tightly shrunken than the portions 15. This shrinkage also tends to concentrate the flock fibres in background areas 16 more densely than the flock fibres 14, 21 in the design areas 15.

The differential shrinkage noted above also tends to cause portions of the fabric to raise upwardly from the plane of the substrate, producing a novel three-dimensional effect.

Accordingly, it will be appreciated that, in accordance with one preferred embodiment, a substrate which may be a cotton fabric or any other shrinkable fabric or material, is printed with an adhesive to form a desired design. A short flock is then flocked upon the areas covered by the printed adhesive. Thereafter, the entire surface of the fabric, including the areas to which short flock has already been applied, is coated with the same or a different adhesive and is then overflocked with the same or a different flock. Thus, some portions of the substrate (the background portions) are covered only with one layer of adhesive and flock, while other (design) areas are covered with adhesive plus short flock plus adhesive plus an overflock.

Another embodiment of this invention is shown in FIGS. 7 to 11 of the drawings. In that embodiment, the substrate 11, 12 is initially subjected to the printing of a design, shown in FIG. 7 as a design of adhesive, hatched for the color orange, and bearing the number 40. According to this embodiment of the invention, no flock is applied to the design areas 40, and a typical swatch of material at this stage of the process appears in FIG. 8. Background areas 41 are left uncoated and typically consist of the substrate 11, 12. As shown in FIG. 9 of the drawings, the design 40 after having been dried is subjected to an all-over printing of another adhesive layer 42, hatched for a different color. Subsequently, the resulting combination is subjected to an overall flocking with the flock 43 as shown in the central and upper right hand portion of FIG. 9, producing an overall flocked appearance such as there shown. Subsequently, the resulting fabric is subjected to shrinkage, to produce a fabric having the general appearance as shown in perspective in the lower right hand corner of the fabric, such portion being designated by the number 44, in FIG. 9.

FIG. 10 shows a typical bath which is utilized for effecting the shrinkage, including a bath 50, guide rollers 51, and hot water 52. The fabric is designated by the number 53.

FIG. 11 shows, enlarged and in section, a typical fabric resulting from the embodiment of the invention illustrated in FIGS. 6 through 10. In this fabric the "design" portions 55 include the adhesive 40 plus the adhesive 42, together with the overflock 43, whereas the background areas 56 contain only the adhesive 42 plus the overflock 43. It will be seen in FIG. 11 that the warp yarns 11 in the areas 56 are arranged much closer to each other than they are in the areas 55, and that the flock 43 in the areas 56 is more tightly arranged than in the areas 55. This is because of the differential shrinkage achieved in processing the fabric 53 through the bath 52 of FIG. 10, which also creates a wrinkled or three-dimensional design effect on the surface of the resulting fabric. Further, an interesting "see through" effect is obtained, as in the case of light shining through a drapery, particularly when the color of the overall adhesive 42 is different from the color of the design adhesive 40.

In the embodiment of FIGS. 7 through 11, the layer 40 need not even be a layer of adhesive at all — it can be a layer of pigment or of color, or of any printable material which has the capability of penetrating into or remaining upon the surface of the substrate.

It will be appreciated, of course, that various other forms of the invention may be utilized, other than the two specific forms illustrated in FIGS. 1 to 6 on the one hand, and in FIGS. 7 through 11 on the other hand.

Those areas which have been printed initially with the adhesive are more effectively stabilized against subsequent shrinkage, either because of the presence of the initial adhesive or of the presence of this adhesive plus the short flock. In contrast, those (background) areas which have been subjected only to subsequently applied adhesive and to subsequently applied flock are much more susceptible to shrinkage; in this connection the adhesive which is used for the overflocking need not be an adhesive of the type used to stabilize the substrate against shrinkage.

Accordingly, when the entire fabric is wetted or heated, or subjected in any way to a shrinking operation, this causes more shrinkage of the relatively unstabilized areas which are covered only with the subsequently applied flock, than the shrinkage of the other relatively stabilized areas. A new and surprisingly different product is thereby achieved.

It will be appreciated that this invention is not limited to a cotton fabric as a substrate, and that a wide variety of other substrates are suitable, provided, of course, that they are shrinkable.

Also, the stabilizer does not need to be flock adhesive, but may be any other kind of surface coating which prevents the substrate from shrinking. It will also be appreciated that the surface coating does not necessarily have to be flocked, and that a lightweight urethane foam coating could be used. Even in that case, however, there is preferably an over-coating of the urethane foam.

It will be understood, also, that the substrate need not be one which is shrinkable in water. It may be a heat-shrinkable substrate, for example, and this shrinking step may comprise running the fabric through an oven or an autoclave or the like, instead of running it through a water bath as illustrated in FIGS. 5 and 10.

Although the species flock, fabric, flock adhesive, and water shrinkage are the preferred forms, a wide variety of alternative forms of the invention may be used.

It will be appreciated that many variations may be made without departing from the scope of this invention. For example, overflocking may be dispensed with in some cases, and differential shrinkage is caused by the fact that some areas have been coated with more adhesive than other areas, or by the fact that some areas have been subjected to adhesive and others have not. By pigmenting the printed adhesive, an additional effect of coloration is achieved, as when light shines through a drapery.

In some cases some shrinkage may be obtained by application of the adhesive in a printed design, followed by drying. This sometimes results in a minimal amount of shrinkage in the printed areas. Subsequent application of an overall adhesive coating in some cases results in some shrinkage in the unprinted areas, which shrinkage is greater than in the previously printed (design) areas. However, subsequent wet processing at higher temperatures (120° – 160° F) contributes much more to the shrinkage. The fact that the unprinted areas shrink more than the printed areas, and that once-printed areas shrink more than twice-printed areas, is believed to be due to the occurrence of less penetration of the adhesive into the substrate in these areas. This appears to result in a condition wherein less of the yarn in the substrate is locked in position, and is thus more free to shrink when subjected to the strong influence of a hot water bath, or to heat. The shrinkage effect is particularly effective on a napped surface, particularly a napped cotton fabric. The initial design may be printed on the napped surface.

Various other changes may be made without departing from the scope of the invention. For example, equivalent elements such as foam polyurethane and other foam sheet materials may be substituted in printed or background designs for the flock and/or the overflock. Further, certain features (flock and overflock, for example) may be used alone and independently of other features, and elements and sequences of the steps of the method may be reversed, all without departing from the spirit and scope of the invention as defined in the appended claims.

The following is claimed:

1. In a method of making a novel fabric on a shrinkable substrate, the steps which comprise:
   a. printing a stabilizing material upon said substrate upon selected design areas to form a design or pattern which at least partially stabilizes said design against shrinkage, and leaves predetermined background areas of said substrate substantially free of said stabilizing material,
   b. drying said material to form a coating having a selected shrinkage inhibiting effect upon said substrate at said design areas,
   c. applying an adhesive to said design and background areas,
   d. flocking upon said adhesive,
   e. drying said adhesive, and
   f. shrinking the entire resulting fabric, whereby differential shrinkage occurs with said design areas shrinking less than said background areas.

2. The method defined in claim 1, wherein said stabilizing material is an adhesive, and wherein flock is also applied to said adhesive in said design area, prior to the application of said adhesive in step (c).

3. The method according to claim 2, wherein said adhesive in step (c) is also applied to said flock applied to said design areas, and wherein an overflock is applied on said step (c) adhesive on top of said flock.

4. The method according to claim 3, wherein said overflock is applied to both said design areas and said background areas.

5. In a method of making a novel fabric on a shrinkable substrate, the steps which comprise printing an adhesive upon said substrate upon design areas to form a design or pattern which leaves background portions of said substrate substantially free of said adhesive, applying flock to the areas covered by said adhesive, drying the adhesive, coating with adhesive the surfaces of the resulting flock and also said background portions which were substantially free of said adhesive, flocking the surfaces thus provided with adhesive and overflocking the areas to which flock was already applied, setting the adhesive and differentially shrinking the resulting fabric.

6. The method defined in claim 5, wherein said substrate is a fabric.

7. The method defined in claim 6, wherein said fabric includes intersecting yarns, and said adhesive applied in said design areas is applied in a manner to anchor the yarns more firmly than in the case of the adhesive applied to said background portions which were initially substantially free of said adhesive.

8. The method according to claim 5, wherein a three-step shrinkage (a), (b) and (c) is caused to occur: (a) by said step of drying the adhesive in said design areas, (b) by drying the adhesive applied to said flock and said portions, with said portions shrinking more than said design areas and (c) wet processing at elevated temperatures which causes said portions to shrink still more than said design areas.

9. In a method of making a novel fabric on a shrinkable substrate, the steps which comprise:

a. printing a shrinkage stabilizing material upon said substrate upon design areas to form an at least partially stabilized design pattern which leaves background portions of said substrate more shrinkable than said design pattern, applying an adhesive to said design areas and to said background areas, c. applying an upstanding material selected from the group consisting of flock and foam to the areas covered by said adhesive, d. drying said adhesive, and e. shrinking the resulting material.

10. The method defined in claim 9, wherein said upstanding material comprises a multiplicity of flock fibres.

11. The method defined in claim 9, wherein said upstanding material comprises foam.

12. The method defined in claim 9, wherein said upstanding material comprises polyurethane foam.

13. The method defined in claim 9, wherein said shrinkage stabilizing material (a) is an adhesive.

14. The method defined in claim 13, wherein flock is applied to said adhesive in step (a), wherein said adhesive is dried prior to step (b), and wherein the adhesive of step (b) is applied over said flock.

15. A differentially shrunk fabric having a novel, three-dimensional design, said fabric comprising a differentially shrunken substrate having a shrinkage stabilizing material applied to said substrate to form a design or pattern which at least partially stabilizes said design against shrinkage, said substrate being composed of said design pattern area and a shrinkable background area adjacent thereto, an upstanding material affixed to both said design pattern area and said shrinkable background area, said background area being shrunken more tightly than said design area.

16. The fabric defined in claim 15, wherein said flock fibres are applied only to said background area.

17. The fabric defined in claim 15, wherein said flock fibres are applied to said design area and other flock fibres are applied to said background area.

18. The fabric defined in claim 15, wherein said upstanding material comprises a plurality of upstanding flock fibres.

19. The fabric defined in claim 15, wherein said upstanding material comprises foam.

20. The fabric defined in claim 15, wherein said upstanding material comprises polyurethane foam.

21. The fabric defined in claim 15, wherein a base layer and a different overlayer are present in said design pattern area, and wherein the material of said overlayer is applied to said background area.

22. The fabric defined in claim 21, wherein said base layer is of a different color than said overlayer.

23. The fabric defined in claim 21, wherein said base layer and said overlayer are both adhesive.

24. The fabric defined in claim 15, wherein a plurality of upstanding flock fibres are applied to said overlayer in both said design pattern area and said background area.

25. A differentially shrunk fabric having a novel three-dimensional design, said fabric comprising a differentially shrunken substrate composed of at least one design area and at least one background area, said design area comprising a base layer of adhesive upon said substrate, a base layer of flock upon said base layer of adhesive, a layer of over-adhesive upon the top of said base layer of flock, and a layer of overflock upon said layer of over-adhesive, said background area comprising a layer of adhesive upon said substrate and a layer of said overflock adhered thereto.

26. The fabric defined in claim 25, wherein said base layer is shorter than said overflock.

27. The fabric defined in claim 25, wherein the flock of said base layer has a length of about 0.005 to 0.025 inch and the overflock has a length of about 0.005 to 0.080 inch.

28. The fabric defined in claim 25, wherein the overflock fibres are longer than the base layer flock fibres by 50 to 200%.

29. A differentially shrunk fabric having a novel three-dimensional design, said fabric comprising a differentially shrunken substrate having adhesive and a plurality of upstanding flock fibres affixed thereto, said substrate being composed of a design area and a background area adjacent thereto, said background area being shrunken more tightly than said design area, wherein said flock fibres are applied only to said design area and other flock fibres are applied to said background area, said other fibres also being overflocked on top of said flocked fibres applied to said design area.

* * * * *